United States Patent [19]

Stone

[11] 4,095,735

[45] Jun. 20, 1978

[54] MULTI-PARTITIONED CARTON

[75] Inventor: Orison W. Stone, New Haven, Vt.

[73] Assignee: Potlatch Corporation, San Francisco, Calif.

[21] Appl. No.: 782,449

[22] Filed: Mar. 29, 1977

[51] Int. Cl.[2] ..... B65D 5/10; B65D 5/48

[52] U.S. Cl. ..... 229/39 R; 206/45.31; 229/28 BC

[58] Field of Search ..... 229/28 BC, 28 R, 37 R, 229/39 R, 27, 29 B, 29 D, 29 F; 206/45.14, 45.31, 443, 140, 193, 194, 199, 45.14

[56] References Cited

U.S. PATENT DOCUMENTS

| | | | |
|---|---|---|---|
| 1,077,322 | 11/1913 | Ward | 229/28 R |
| 2,339,176 | 1/1944 | Lee | 229/28 BC |
| 2,545,589 | 3/1951 | Samsing | 229/28 BC |
| 2,588,791 | 3/1952 | Andrew, Jr. | 206/194 |
| 2,739,735 | 3/1956 | Anderson, Jr. | 229/28 BC |
| 2,747,767 | 5/1956 | Bergstein | 229/28 BC |
| 2,883,098 | 4/1959 | Horner et al. | 229/28 R |
| 3,337,046 | 8/1967 | Roy et al. | 206/194 |
| 3,365,098 | 1/1968 | Sims | 229/28 BC |
| 3,414,182 | 12/1968 | Fobiano | 229/30 |
| 3,446,414 | 5/1967 | Omori | 229/28 R |

FOREIGN PATENT DOCUMENTS

| | | | |
|---|---|---|---|
| 268,988 | 2/1969 | Austria | 229/28 R |
| 1,016,187 | 9/1957 | Germany | 229/28 R |

*Primary Examiner*—William Price
*Assistant Examiner*—Allan N. Shoap
*Attorney, Agent, or Firm*—Jack E. Dominik

[57] ABSTRACT

A knock-down, easily erected, multi-partitioned carton formed from a single blank of foldable paperboard is disclosed. The multi-partitioned carton comprises a pair of side panels, a pair of end panels, a plurality of pairs of opposed tongues formed by cutting and scoring the side panels. The opposed tongues are hingedly attached on one end to the side panels and at the other end to each other when folded inward so as to define a plurality of cells or compartments. A pair of bottom flaps hingedly attached to each of the side panels automatically form a bottom as the carton is squared. In one alternative embodiment of the carton a pair of interlocking collar halves formed from cutting and scoring the side panels allows for the defining of a plurality of article receiving apertures therebetween. In yet another embodiment of the carton, a single gang lift element is formed by cutting and scoring one of the side panels so that the gang lift element in combination with tongues further subdivide each cell or compartment.

12 Claims, 11 Drawing Figures

MULTI-PARTITIONED CARTON

FIELD OF THE INVENTION

The present invention relates to cartons having multiple cells or compartments, and more particularly to cartons capable of packaging a plurality of fragile articles in containers which are subdivided in partitions.

DESCRIPTION OF PRIOR ART

The present state of the art in the carton and packaging industry recognizes the utilization of tongues cut and scored from panels for the defining of a plurality of compartments in which packaged fragile articles, such as glass bottles, can be securely contained so that these articles are not thrown against each other and broken. The cartons of this type, which are used to package fragile articles by subdividing the interior of the carton with partitions, must be relatively strong and rigid to adequately protect the fragile contents, while having a design which minimizes the use of board and therefore minimizes the cost. Furthermore, it has become a common practice in the industry to transport knocked down cartons, which have been previously glued, to the manufacturer or customer, who will subsequently assemble the carton. The easier the assembly of such a carton at the customer's or manufacturer's location, the more desirable the carton is in a competitive market. The prior art patents utilizing one tongue to define partitions are found in U.S. Pat. Nos. 2,263,455 and 3,065,876. The use of a pair of opposed tongues to define partitions also exists in the prior art, as shown by U.S. Pat. Nos. 2,883,098 and 3,414,182. One of the many problems which arises with these prior art carton designs is their incapability of being shipped in a knocked-down condition or a bottom design which requires considerable assembly effort.

It has also been found desirable to have the articles, such as bottles of deodorant, visible inside their partitions. Furthermore, due to the competitive nature of mass producing cartons, it is necessary to have a blank that has a substantially rectangular configuration, permitting layout and nesting of the blanks on a sheet of board to minimize board use. Therefore, it is clear that the carton disclosed in U.S. Pat. No. 2,883,098, for example, fails to provide a design in which the contents contained therein are visible and also fails to provide a blank design which minimizes the use of board.

Additionally, the problem has arisen that with some fragile articles the formation of partitions has been inadequate in protecting the articles from breakage. In other words, although the tongue arrangement may help to provide a strong and rigid structure to the carton, additional precautions must be taken in order to insure these articles are not broken. Therefore, the cartons utilizing tongues to create multiple partition containers have in some cases been found to be insufficient in their prevention of breakage.

Accordingly, it can be seen that there is a need in the packaging industry for a knock-down type carton capable of quick erection with a minimum of effort, structurally rigid and stable so as not to loose its articles receiving configurations, capable of retaining the articles in a manner preventing breakage, which provides for visibility of such articles contained therein, and which minimizes the use of board by an efficient design having proper nesting relationships between blanks so as to be inexpensive to manufacture.

SUMMARY

The present invention relates to a knock-down, easily erected, multiple - partitioned carton formed from a single blank of foldable paperboard or like sheet material comprising a pair of side panels, a pair of end panels, at least one pair of opposed tongues with each side panel cut and scored to define one of the pair of opposed tongues. The pair of opposed tongues form a reinforcement partition by attachment of the ends of each to each other. On the bottom of the carton a pair of bottom flaps is provided with each bottom flap having a bottom tab hingedly attached to the same along an angled fold line. Each of the angled fold lines intersect the adjacent junction of the end panel with the side panel and are each disposed in a line which bisects the angle formed between the end panel and the side panel. This arrangement on the bottom allows the bottom flaps to be initially position in parallel relationship to the side panels when the carton is in its knocked-down position, while forcing the bottom flaps into a substantially perpendicular disposition when the carton is squared. Additionally, once the bottom flaps have formed a bottom by the squaring of the carton, they are maintained in their bottom forming condition by the bottom flaps automatically locking to maintain the carton in its rigid erected condition. The cutting and scoring of the side panels to create the tongues also forms a plurality of windows which are utilized to make visible the articles contained within the carton.

In an alternative embodiment of the present invention, a pair of interlocking collar halves are provided with one of said pair being created by cutting and scoring each of the side panels. The collar half hingedly attached to one side panel lockingly engages the collar half hingedly attached to the other side panel so as to define therebetween a plurality of articles receiving apertures.

In another alternative embodiment of the present invention, the tongues cut and scored from one of the side panels are further cut and scored to form divided tongues and a gang lift element. By virtue of having this gang lift element, each area between a pair of opposed tongues and the next pair of opposed tongues or the end panels is further divided into two compartments or cells, doubling the total number of compartments or cells included within the carton.

In view of the foregoing, it is an important object of the present invention to provide a knock-down, easily erected, multi partitioned carton formed from a single blank of foldable paperboard or like sheet material.

It is a related object of the present invention to provide a knock-down, easily erected, multiple-partitioned carton which upon squaring from an initially knocked-down condition automatically forms a bottom, automatically forms at least one reinforcing partition to define a plurality of cells or compartments, and automatically locks to maintain a rigid erected condition.

Yet another related object of the present invention is to provide a knock-down, easily erected, multi-partitioned carton so that the compartments or cells are relatively strong and rigid to adequately protect their fragile contents from being thrown against each other and broken.

Another more detailed object of the present invention is to provide a knock-down, easily erected, multi-partitioned carton with bottom flaps capable of erection or set up by the squaring of the carton.

Another more detailed object of the present invention is to provide a knock-down, easily erected, multi-partitioned carton capable of automatically forming a plurality of compartments for receiving articles by the squaring of the carton.

A further and very important object of the present invention is to provide a plurality of windows defined by the formation of the tongues whereby the articles contained within the carton are clearly visible.

Still another object of the present invention is presented in an alternative embodiment is to provide collar means for particularly fragile articles so as to prevent their breakage.

An additional and important object of the present invention is to provide a carton having a blank which is substantially rectangular blank permitting layout and nesting of a plurality of blanks on a sheet of board to minimize board use.

Still another related object of the present invention is to provide a knock-down, easily erected, multi-partitioned carton which lends itself to economical fabrication and assembly by automatic methods.

Still another object of the present invention is to provide a multi-partitioned carton that protects the articles in the compartments thereof, and yet displays the articles to stimulate the purchase of the articles when the carton is positioned on the shelves of the stores.

DESCRIPTION OF THE DRAWINGS

Further objects and advantages of the present invention will become apparent as the following description proceeds, taken into conjunction with the accompanying drawings in which.

DETAILED DESCRIPTION OF THE PREFERRED EMBODIMENT

Figures 1, 2, 3, 4, 5:
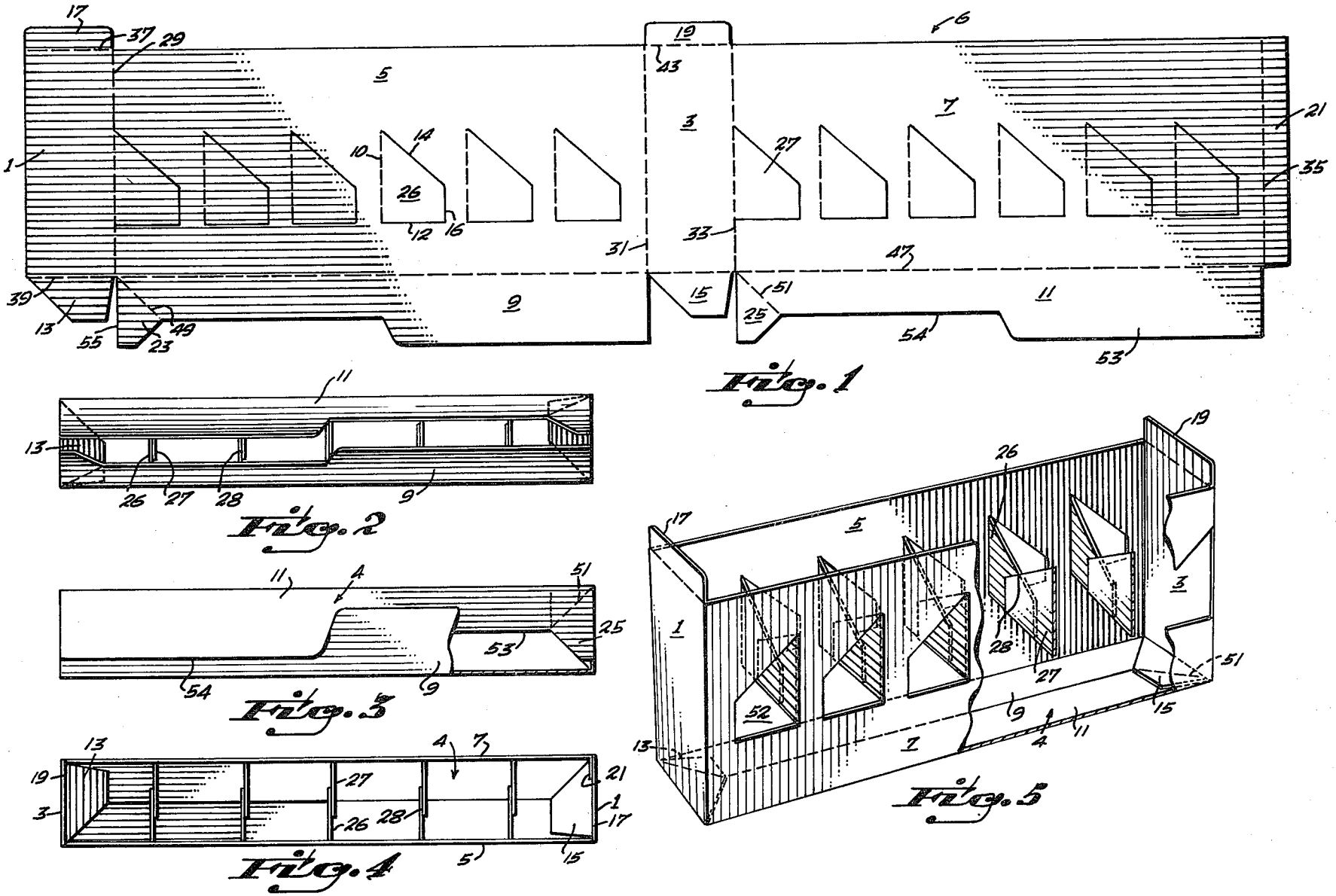
FIG. 1 is a plan view of the carton blank for the preferred embodiment.
FIG. 2 is a bottom view of the subject cartons of the present invention with the bottom partly erected.
FIG. 3 is a partially broken away bottom view of the subject cartons of the present invention with the bottom completely erected.
FIG. 4 is a top view of the subject carton of the preferred embodiment.
FIG. 5 is a perspective view partially broken away of the erected and operative carton formed from the blank shown in FIG. 1.

As shown in FIG. 1, a knocked-down, easily erected, multi-partitioned carton 2 is in the form of a single blank 6 which is unglued and unfolded. This blank 6 is preferably made of foldable paperboard or like sheet material. The carton 2 comprises a pair of side panels, front side panel 7 and rear side panel 5, and a pair of end panels 1 and 3 and an end flap 21. End panel 3 is hingedly attached on opposite sides by score lines 31 and 33 to side panels 5 and 7 respectively. End panel 1 is hingedly attached by score line 29 to rear side panel 5 and end flap 21 is hingedly attached to front side panel 7 by score line 35. All of the score lines heretofore mentioned, score lines 29, 31, 33, and 35, are disposed in parallel spaced-relationship to each other. The carton is further provided with bottom flaps 9 and 11 which are hingedly attached by score lines 41 and 47 respectively to rear side panel 5 and front side panel 7 respectively. Hingedly attached to end panels 1 and 3 on the upper edges thereof by score lines 37 and 43 respectively are top tabs 17 and 19 respectively. On the opposite bottom edges of end panels 1 and 3, end tabs 13 and 15 are hingedly attached respectively by score lines 39 and 45. Score lines 37, 39, 41, 43, 45, 47, are all disposed in parallel relationship to each other. Hingedly attached by fold lines 49 and 51 to bottom flaps 9 and 11 respectively are bottom tabs 23 and 25 respectively.

As can be seen from FIG. 1, ideally, pairs of opposed tongues 26 and 27 are provided, with tongues 26 being cut and scored from rear side panel 5 and tongues 27 being cut and scored from front side panel 7. Each tongue 26 and 27 is cut on one side 16, bottom 12 and top 14, with the remaining side 10 being hingedly attached by a fold line to the appropriate side panel 5 or 7. The tongues 26 and 27 are dimensioned and configured so that the articles contained within the carton will be clearly visible so as to properly display the same to a potential purchaser. As can clearly be seen in FIG. 4, the multi-partitioned carton 2 is subdivided into a number of cells or compartments 4 by opposed pairs of tongues 26 and 27 which extend and meet across the interior of carton 2 as the tongues are folded inwardly. The opposed pairs of tongues 26 and 27 are fastened together ideally by glue which is deposited on their mating surfaces. It should be noted that although the preferred embodiment shows six cells 4, any number of cells can be utilized with the present invention. However, the greater the number of cells 4, the greater the number of reinforcement partitions 28 created by opposed tongues 26 and 27. Therefore the increase in number creates better visibility of the contents with the reinforcement partitions 28 providing greater structural strength and rigidity to the carton 2. Each tongue 26 and 27, upon being folded inwardly about its hinged edge will leave behind an aperture 52 formed in the side wall 5 or 7. It is through this plurality of apertures 52 that the contents of the carton become visible.

FIGS. 4 and 5 shows the carton 2 in its glued and folded condition with the carton 2 squared so that the end panels 1 and 3 and the side panels 5 and 7 are positioned consecutively at right angles to each other. Reinforcing partition 28 are disposed at substantially right angles to the side panels 5 and 7 when the carton is erected. It is preferable that the hingedly attached edge 16 of tongue 26 be correspondingly aligned with the hinged edge 16 of the cooperatively positioned tongue 27 so as to create this perpendicular relationship of the reinforcing partitions 28. As shown in FIGS. 2 and 3, the bottom flaps 9 and 11 automatically lock to maintain the carton securely and firmly erect without the use of fastening materials such as glue. The bottom flaps 9 and 11 are hingedly attached to the bottom tabs 23 and 25 by angle fold lines 49 and 51 respectively. These angled fold lines 49 and 51 are disposed in a line which bisects the angle formed between the end panels and the side panels and also intersect the junction of the end panels with the side panels. The bottom tabs 23 and 25 are attached, ideally by glue, to end tabs 13 and 15. Due to this design, the bottom flaps 9 and 11 are disposed flatly against the side panels when the carton is collapsed or in its knock-down condition. As the carton is squared, the bottom flaps 9 or 11 are automatically drawn outward relative to the side panels 5 and 7 and thereby forming a bottom to the carton 2. This bottom construction of the carton allows for the formation of the carton bottom without added assembly equipment or manual effort. Collapsed carton 2 is erected to the form as shown in FIG. 5 simply by pressing against the corners of the collapsed carton. This causes the carton to assume its generally rectangular shape whereupon the bottom flaps 9 and 11 are drawn outward to form the carton's bottom. Prior to squaring the carton, the end flap 21 must be secured to the end panel 1 and the end tabs 13 and 15 must be secured to the bottom tabs 23 and 25 respectively, all being preferably secured adhesively. Having been glued and folded, the carton 2 can be arranged in its knock-down condition for shipment to the users location, and then subsequently set up by squaring for receiving articles.

The automatic locking of the bottom flaps 9 and 11, as previously mentioned, is accomplished by providing the bottom flaps with an extended portion 53 and a recessed portion 54. The extended portion 53 of one of the bottom flaps 9 or 11 lockingly engages the recessed portion of the other bottom panel 9 or 11 when the carton is squared. This automatic locking feature of the carton maintains the carton in a firm and rigid set up condition. Ideally, the bottom tabs 23 and 25 have a substantially triangular configuration with the edge 55 having a length substantially equal to the width of the end panels 1 and 3. This allows for a structurally superior bottom and further prevents one bottom flap from disengaging from the other bottom flap.

Figure 6:
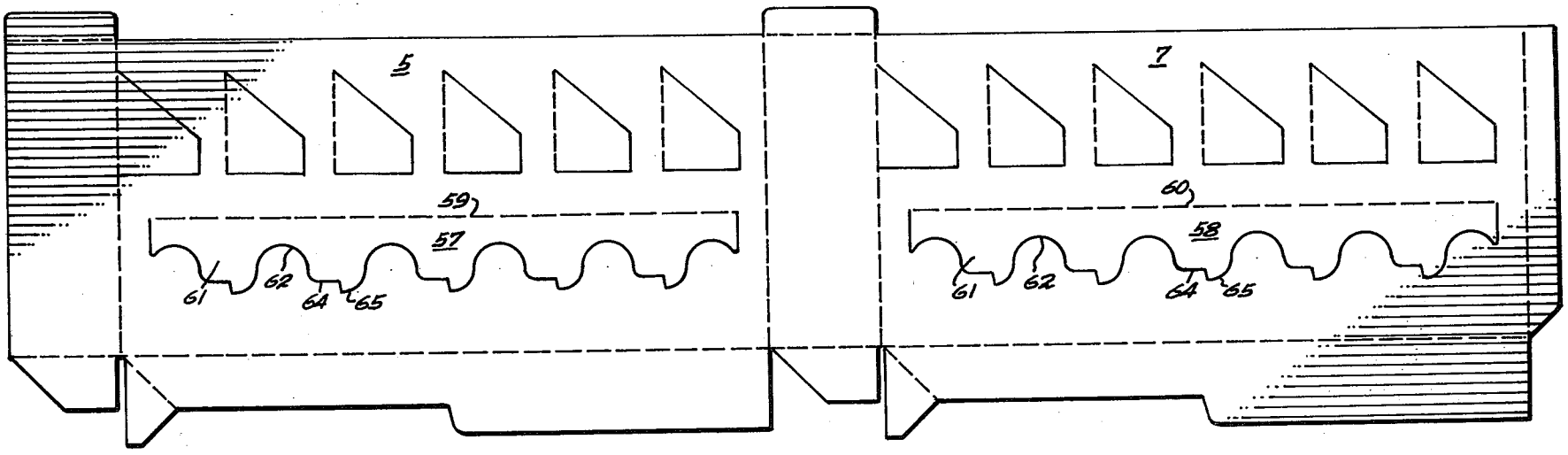
FIG. 6 is a plan view of the carton blank for the first alternative embodiment of the present invention which includes a collar.
Figure 7:
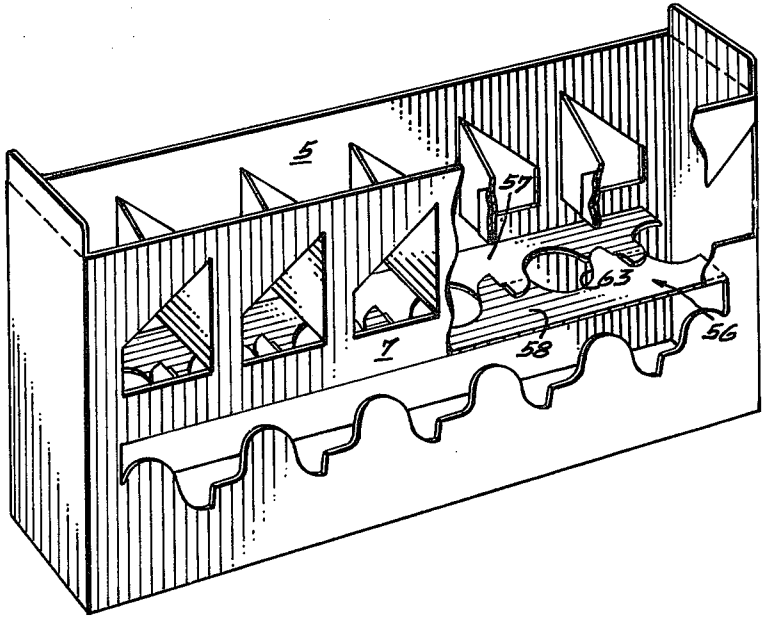
FIG. 7 is a perspective view partially broken away of an erected and operative carton formed from the blank shown in FIG. 6.

In an alternative embodiment of the present invention shown in FIGS. 6 and 7, a further structural feature is added to help maintain particularly fragile articles in a firmly secured disposition within the carton. A collar 56 formed from two collar halves 57 and 58 is utilized to securely encase each of the articles contained within the carton 2. This pair of interlocking collar halves 57 and 58 are cut and scored from side panels 5 and 7 respectively. Each of the collar halves 56 and 57 have one edge hingedly attached by fold lines 59 and 60 respectively to side panels 5 and 7 respectively. These fold lines 59 and 60 are aligned in substantially perpendicular relationship to the junction of the side panels with the end panels. Each of the collar halves 56 and 57 have alternating prong portions 61 and notch portions 62 with each prong portion 61 of one collar half 57 and 58 lockingly engaging a corresponding prong portion 61 of the other collar half 57 or 58 when the carton is erected. Each notch portion 62 of one collar half 57 or 58 is cooperatively positioned relative to the corresponding notch portion of the other collar half 57 or 58 to define a article receiving aperture 63 therebetween. This aperture 63 is dimensioned and configured to correspond to the cross-sectional dimensions and configuration of the article which is to be encased therein. Each prong portion 61 of each of the collar halves 57 and 58 include a relieved portion 64 and an extended portion 65 with each being disposed in side by side relationship on the outer free edge of the prong portion 61. Each extended portion 64 of each prong portion 61 of one collar half 57 or 58 is disposed in overlapping relationship to the relieved portion 65 of the correspondingly positioned prong portion 61 of the other collar half 57 or 58. Furthermore, the relieved portion 64 extends outward from the hinged edge of the collar halves 57 and 58 a distance greater than one half the width of the end panels 1 and 3. This forces the collar halves to angle upward relative to the top and bottom of the carton and therefore allows for added structural strength. The mesh arrangement of a pair of adjacent overlapping relieved and extended portion 54 and 58 on each of the prong portions 61 allows for securely maintaining the opposed prongs in locking engagement.

Figure 8:
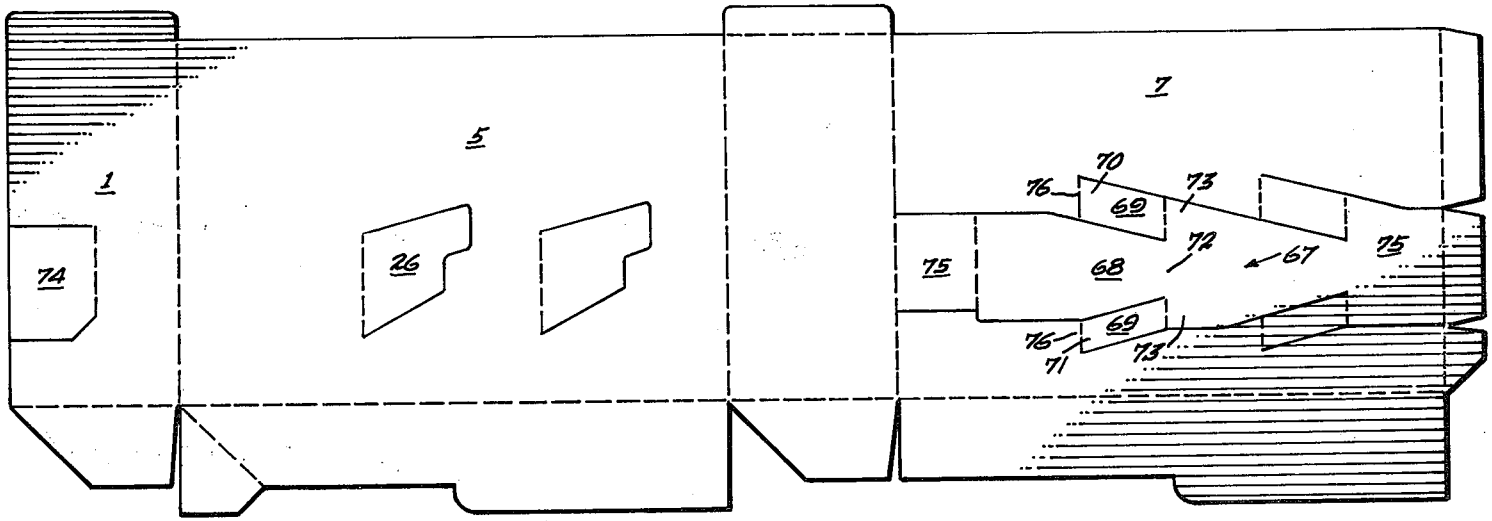
FIG. 8 is a plan view of the carton of the second alternative embodiment of the present invention which includes a single gang lift element.
Figure 10:
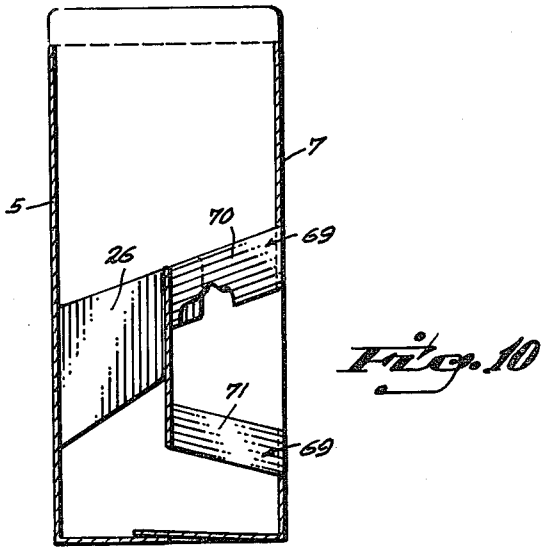
FIG. 10 is a transverse cross-sectional view of the carton shown in FIG. 9 taken along section line 10 — 10.
Figure 9:
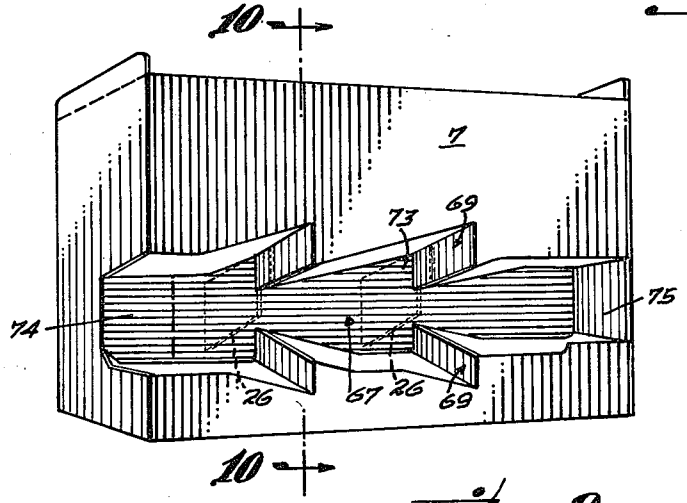
FIG. 9 is a perspective view of an erected and operable carton formed from the blank shown in FIG. 8.

Another alternative embodiment of the present invention is shown in FIGS. 8, 9, and 10. In this embodiment, the front side panel 7 and end panel 1 are cut and scored to define a gang lift element 67. More specifically, extension member 74 is cut and scored from end panel 1 so that it is hingedly attached toward the central area of end panel 1. On the end of front side panel 7 adjacent in panel 3, extension member 75 is cut and scored so that it is hingedly attached to the junction of front side panel 7 and end panel 3. Between opposed extension member 74 and 75, there is defined by cutting and scoring front side panel 7 a tree member 68. Tree member 68 comprises a trunk portion 72 and a plurality of pairs of opposed branch portions 73 therefore a single gang lift element 67 is defined to include extension members 75 and tree member 68 having a trunk portion 72 and a branch portion 73. The tree member 68 is disposed in dividing relationship to a plurality of divided tongue 69. In other words, in this embodiment of the present invention, the tongues cut and scored from front side panel 7 are further cut and scored by the formation of the tree member 68 so that each divided tongue 69 includes a first tongue half portion 70 and a second tongue half portion 71. For each pair of opposed tongue half portions 70 and 71 there is cooperatively positioned on the tree member 68 a pair of opposed branch portions 73. Each of the divided tongue half portions 70 and 71 are hingedly attached at one end to front side panel 7 and at the other opposed end to one of the pair of opposed branch portions 73. By virtue of this cutting and scoring, the tree member 68 is hingedly attached to said divided tongues 69 for rotation between a position co-planar with the front side panel 7 and a partitioned forming position with said divided tongues 69 disposed substantially perpendicular to the side panel 7. Furthermore, the portion of the divided tongue member 69 that is hingedly attached to the front side panel 7 and the tree member 68 define a plurality of corner braces 76. More specifically, there will be a pair of opposed corner braces oppositely situated on each side of the trunk portion 72 for each divided tongue member 69. These opposed corner braces 76 provide a mounting means by which the divided tongue member 69 is hingedly attached to front side panel 7. By utilizing this single gang lift element 67 along one of the side panels 5 or 7, preferably front side panel 7, each area between adjacent end panels 1 or 3 and pairs of opposed tongues 26 and 27 is sub-divided into two compartments. In other words, the number of compartments or cells 4 in this embodiment of the present invention is double over the other embodiments previously described.

Figure 11:
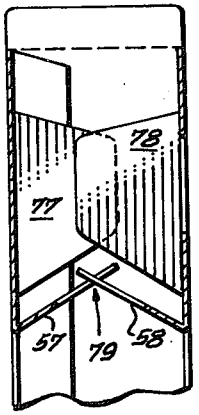
FIG. 11 shows a transverse cross-sectional view of a carton similar to that of FIG. 6 except having tongues of different configuration.

As shown in FIG. 11, the tongues of this first alternative embodiment can be tapered inwardly as proceeding from the hinged edge of the opposed tongues 77 and 78. This allows for the upwardly extending collar halves 57 and 58 to be positioned in closer proximity to the collar 56. More specifically, the groove defined 79 defined by the opposed tongues 77 and 78 permits nesting of the collar 56 so as to reduce the maximum required height of the carton.

Although particular embodiments of the invention have been shown and described in full here, there is no intention to thereby limit the invention to the details of such embodiments. On the contrary, the intention is to cover all modifications, alternatives, embodiments, usages and equivalents of the subject invention as fall within the spirit and scope of the invention, specification and the appended claims.

What is claimed is:

1. A knock down, easily erected, multi-partitioned carton formed from a single blank of foldable paperboard or like sheet material comprising, a pair of side panels, front side panel and rear side panel;

a pair of end panels disposed in joining relationship between said side panels;

at least one pair of opposed tongues, one tongue of said pair of opposed tongues formed in one side panel of said pair of side panels and the other tongue of said pair of opposed tongues formed in the other side panel of said pair of said panels, each tongue of said pair of opposed tongues having one edge hingedly attached to one of said side panels, said hingedly attached edge of said tongue of said pair of opposed tongues being aligned in parallel relationship to the hingedly attached edge of the other said tongue of said pair of opposed tongues;

said pair of opposed tongues directly attached to each other in partially overlapping parallel relationship whereby a carton partitioned is formed;

a pair of bottom flaps, one bottom flap of said pair of hingedly attached to one side panel of said pair of side panels and the other bottom flap of said pair hingedly attached to the other side panel of said pair of side panels, each said bottom flap having a bottom tab hingedly attached to the same along an angled fold line;

each said angled fold line intersecting the adjacent junction of said end panel with said side panel, each said angled fold line disposed in a line which bisects the angle formed at the adjacent junction between said end panel and said side panel;

a pair of end tabs hingedly attached to the bottom edge of each of said end panels and each end tab disposed in overlapping affixed relationship to the corresponding said bottom tab, whereby said bottom flaps initially positioned in parallel relationship to said side panels when the carton is in its knocked down condition are forced into a substantially perpendicular disposition when said carton is squared;

each said bottom flap having an extended portion and a recessed portion, said extended portion of one said bottom flap disposed in locking engagement with the recessed portion of the other said bottom flap when said carton is squared, whereby said bottom flaps automatically lock when said carton is squared so as to maintain the carton in its squared condition;

a plurality of windows defined by the formation of said tongues within each said side panel, whereby articles contained within each partition area of said carton is clearly visible, one of said pair of end panels hingedly attached on opposite sides by score lines to each said side panels, the other of said pair of end panels hingedly attached by a score line to said rear side panel;

an end flap hingedly attached by a score line to said front side panel;

said bottom flaps hingedly attached by a score line to each of said side panel;

said end tabs hingedly attached by a score line to each of said end panels;

whereby said multi-partitioned carton upon squaring from an initially knocked-down condition automatically forms a bottom, automatically locks to maintain a rigid erected condition and automatically forms at least one partition comprising said pair of opposed tongues to define a plurality of cells or compartments and to structurally maintain the side panels in rigid spaced apart relationship and is formed from a single sheet of paperboard or like sheet material with the minimum of board usage.

2. A multi-partitioned carton as in claim 1, said hingedly attached edge of each said end tab extending along substantially the entire bottom edge of said end panel, whereby structural support is provided for retaining said bottom flaps in content containing disposition.

3. A multi-partitioned carton as in claim 1, each said tongue on one of said side panels comprising a pair of vertically spaced-apart half tongue portions;

a gang lift element formed on the same said side panel having said pairs of half tongue portions;

said gang lift element having a tree member and a pair of opposed extension members attached on opposed ends of said tree member;

said tree member disposed in dividing relationship to each said pair of half tongue portions;

said tree member hingedly attached to said half tongue portions for rotation between a position coplanar with said side panel and a partition forming position with said half tongue portions disposed substantially perpendicular to said side panels.

4. A multi-partitioned carton as in claim 3, said tree member having a trunk portion and a pair of opposed branch portions for each said pair of half tongue portions laterally disposed along said trunk portion;

each of the half tongue portions of said pair of half tongue portions hingedly attached to one of said pair of opposed branch portions;

whereby each area formed between adjacent end panels and pairs of opposed tongues is subdivided into two compartments.

5. A multi-partitioned carton of claim 4, a pair of opposed corner braces for each said pair of half tongue portions defined in said side panel;

said side panel hingedly attached to each said pair of half tongue portions by said pair of opposed corner braces;

one of said end panels cut and scored to define one of said pair of opposed extension members, said extension member being hingedly and centrally attached to said end panel, the other said extension member being hingedly attached to the edge of the other said end panel.

6. A multi-partitioned carton for receiving a plurality of articles formed from a single blank of foldable paperboard or like sheet material, such carton comprising;

a pair of side panels, front side panel and rear side panel;

a pair of end panels disposed in joining relationship between said side panels;

at least one pair of opposed tongues with each said side panel cut and scored to define one of said pair of opposed tongues;

each said tongue of said pair of opposed tongues having one edge hingedly attached to one of said side panels;

said pair of opposed tongues directly attached to each other whereby a plurality of windows are formed to make visible the contents within the carton and to maintain the side walls in rigid spaced apart relationship;

a pair of interlocking collar halves with each side panel cut and scored to define one of said pair of interlocking collar halves below said pair of opposed tongues;

each said collar half having one edge hingedly attached to one of said side panels and said hingedly attached edge aligned in substantially perpendicular relationship to the junctions of said side panels with said end panels;

said pair of interlocking collar halves defining therebetween a plurality of article receiving apertures.

7. A multi-partitioned carton as in claim 6, each of said pair of interlocking collar halves having alternating prong portions and notch portions;

each said prong portion of one collar half lockingly engages a corresponding prong portion of the other said collar half when said carton is erected;

each said notch portion of one said collar half cooperatively positioned relative to the corresponding said notch portion of the other said collar half to define said article receiving apertures.

8. a multi-partitioned carton as in claim 7, each said prong portion of each said collar half including a relieved and extended portion with each disposed in side by side relationship on the outer free edge of said prong portion;

each said relieved portion of each said prong portion of one said collar half aligned and dimensioned for overlapping relationship to said relieved portion of the correspondingly positioned said prong portion of said other collar half; whereby the meshed arrangement of the pair of adjacent overlapping said relieved and extended portions for each pair of cooperatively positioned said prong portions of different said collar halves securely maintains said pair of interlocking collar halves in locking engagement.

9. A multi-partitioned carton as in claim 8, each said relieved portion extending outward from said hinged edge of said collar half a distance greater than one half of the width of said end panels;

whereby said collar halves are forced in an angled upward alignment relative to the top and bottom of said carton and therefore allow for added structural strength.

10. A knock-down, easily erected, multi-partitioned carton formed from a single blank of foldable paperboard or like sheet material comprising, a pair of side panels, front side panel and rear side panel;

a pair of end panels disposed in joining relationship between said side panels;

at least one pair of opposed tongues with each said side panel cut and scored to define one of said pair of opposed tongues;

each tongue of said pair of opposed tongues having one edge hingedly attached to one of said side panels, said hingedly attached edge of one said tongue of said pair of opposed tongues being aligned in parallel said pairelationship to the hingedly attached edge of the other said tongue of said pair of opposed tongues;

said pair of opposed tongues directly attached to each other in the proximity of a portion of each said tongue opposed to said hingedly attached edge of the same;

a pair of bottom flaps, one bottom flap of said pair hingedly attached to one of said pair of side panels and the other bottom flap of said pair hingedly attached to the other side panel of said pair of side panels, a gang lift element formed on the same said side panel having said pairs of half tongue portions;

said side panel having said divided tongue further cut and scored to define a gang lift element;

said gang lift element having a tree member and a pair of opposed extension members attached on opposed ends of said tree member;

said tree member disposed in dividing relationship to said each said pair of half tongue portions;

said tree member hingedly attached to said half tongue portions for rotation between a position coplanar with said side panel and a partition forming position with said half tongue portions disposed substantially perpendicular to said side panels.

11. A multi-partitioned carton of claim 10, said tree member having a trunk portion and a pair of opposed branch portions for each said divided tongue laterally disposed along said trunk portion;

each of the half tongue portions of said pair of half tongue portions hingedly attached to one of said pair of opposed branch portions;

whereby each area formed between adjacent end panels and pairs of opposed tongues is subdivided into two compartments.

12. A multi-partitioned carton of claim 11, a pair of opposed corner braces for each said pair of half tongue portions defined in said side panel;

said side panel hingedly attached to each said pair of tongue portions by said pair of opposed corner braces;

one of said end panels cut and scored to define one of said pair of opposed extension members, said extension member being hingedly and centrally attached to said end panel, the other said extension member being hingedly attached to the edge of the other said end panel.

* * * * *